US006973908B2

(12) United States Patent
Paro

(10) Patent No.: US 6,973,908 B2
(45) Date of Patent: Dec. 13, 2005

(54) APPARATUS AND METHOD OF LUBRICATING OF PISTON ENGINE

(75) Inventor: Daniel Paro, Kvevlax (FI)

(73) Assignee: Wartsila Technology Oy AB, Helsinki (FI)

( * ) Notice: Subject to any disclaimer, the term of this patent is extended or adjusted under 35 U.S.C. 154(b) by 0 days.

(21) Appl. No.: 10/297,558

(22) PCT Filed: Jun. 13, 2001

(86) PCT No.: PCT/FI01/00555

§ 371 (c)(1),
(2), (4) Date: Dec. 9, 2002

(87) PCT Pub. No.: WO01/98638

PCT Pub. Date: Dec. 27, 2001

(65) Prior Publication Data

US 2003/0131819 A1 Jul. 17, 2003

(30) Foreign Application Priority Data

Jun. 19, 2000 (FI) ..... 20001450

(51) Int. Cl.[7] ..... F01M 1/16
(52) U.S. Cl. ..... 123/196 R
(58) Field of Search ..... 123/196 R, 196 M

(56) References Cited

U.S. PATENT DOCUMENTS 4,094,293 A 6/1978 Evans
4,452,188 A * 6/1984 Kosuda et al. ..... 123/196 R
5,396,867 A * 3/1995 Ito et al. ..... 123/196 R
5,526,783 A 6/1996 Ito et al.
5,537,959 A 7/1996 Ito
5,826,556 A 10/1998 Ruman et al.
5,950,591 A * 9/1999 Kageyama et al. ..... 123/196 R
5,951,342 A * 9/1999 Ozawa et al. ..... 123/196 R
6,386,170 B1 * 5/2002 Iwano et al. ..... 123/196 R
6,443,263 B1 * 9/2002 Ito et al. ..... 123/196 R
6,523,519 B2 * 2/2003 Iwano et al. ..... 123/196 R

FOREIGN PATENT DOCUMENTS

DE 44 41 440 5/1996
GB 2 058 952 4/1981

* cited by examiner

*Primary Examiner*—John Kwon
*Assistant Examiner*—Jason Benton
(74) *Attorney, Agent, or Firm*—Smith-Hill and Bedell

(57) ABSTRACT

An arrangement for lubricating a piston engine comprising a source of lubrication medium, first pressure elevating means for elevating the pressure of the lubricating medium, and first ducting means for delivering the lubricating medium to lubrication targets of the engine. The arrangement comprises at least one second ducting means which is separate from the first ducting means and which is provided with a valve arrangement controllable by external control for controlling flow of lubricating medium in the second ducting means. The second ducting means is connectable in now communication with a source of lubricating medium through the valve arrangement. The invention relates also to a corresponding method.

18 Claims, 2 Drawing Sheets

APPARATUS AND METHOD OF LUBRICATING OF PISTON ENGINE

TECHNICAL FIELD

This invention relates to an arrangement for lubricating a piston engine. The invention also relates to a method of lubricating a piston engine.

BACKGROUND ART

Forced circulation lubricating systems are commonly used for lubricating of various rotational and moving parts of combustion engines. Typically lubricating medium is fed by means of a delivery ductwork system from a container to lubrication targets, after which the lubricating medium is accumulated and led back to the container. In modern diesel engines the pressure for circulating the lubricating medium is provided by oil pumping means. Typically an oil pump sucks oil from the oil sump of the engine and pumps the oil through a cooler and filter to the ductwork or channels leading to the various lubrication targets. From the lubricated targets the oil drains back to the bottom of the crankcase to the oil sump. The system is designed so that the pressure of the oil is suitable for lubricating the lubrication targets. However, with this known kind of system, there are the disadvantages that the pressure of the oil is dependent on the rotating speed of the engine and the oil pressure is approximately constant at various parts of the lubricating system. Thus the system does not take into account specific requirements for different lubrication targets or operational circumstances.

Specifically the feeding of lubricating oil for piston units includes drawbacks in the case of large two-stroke engines. In EP-A-0903473 there is shown a lubricating system for a large two-stroke engine, in which the lubricating medium is delivered to the piston by means of separate linked levers provided with flow channels. A separate oil feeding device is provided for each cross head, which device operates by the effect of reciprocating movement of the cross head. In this known system the feed of lubricating medium is also set to a certain level, which is not adjustable during the operation of the engine and thus does not necessarily correspond to the optimum lubrication for all operating circumstances.

Another known lubricating system is shown in GB-A-2058952. This known lubricating system utilises fully electronically controlled valves. However this known solution is unnecessarily complicated.

The main bearings of engine crankshafts are usually hydrodynamic bearings. The efficiency of lubricating such bearings is based on creating a film of oil between the bearing surfaces. The settling of the shaft is dependent on, among other matters, the peripheral velocity of the shaft pin. Thus the lubrication is not ideal, for example, during engine start-up.

It is an aim of the present invention to provide a lubricating arrangement for a piston engine which minimises the shortcomings of the prior art. Specifically an aim of the invention is to provide a lubricating arrangement by means of which the feeding of lubricating medium for lubricating engine parts, e.g. pistons, takes place reliably and efficiently. It is also an aim of the invention to provide a method of lubricating a piston engine, in which shortcomings of the prior art are minimised.

DISCLOSURE OF THE INVENTION

According to one aspect of the present invention there is provided an arrangement for lubricating a piston engine comprising a source of lubricating medium, pressure elevation means for the lubricating medium, and a first ducting means for leading the lubricating medium to lubrication targets of the engine. Additionally the arrangement comprises a second ducting means, which is separate from the first ducting means, and which has been provided with a valve arrangement controllable by external control for controlling flow of lubricating medium in the second ducting means. The second ducting means is connectable in flow communication with a source of lubricating medium through the valve arrangement.

The second ducting means preferably comprises second pressure elevating means separate from the first pressure elevating means, which facilitates better independent control over the process.

The separate second ducting means may be arranged as a section of the first ducting means of the piston engine, whereas the engine comprises both a traditional forced circulating lubricating system and a separate delivery ductwork section which is provided with a valve arrangement controllable by an external control unit. Hence it is advantageous that the separate second ducting means is connected to the first ducting means, i.e. to the traditional forced circulating lubrication system, as a first branching duct in a flow direction of the lubricating medium after the pressure elevating means, whereas the obtainable pressure level is at its highest.

Preferably the arrangement comprises a pressure accumulator in flow communication with the source of lubricating medium, to which accumulator the second ducting means is connectable by means of said valve arrangement. Lubricating medium is fed by a pressure elevating means first to a pressure accumulator, in which a predetermined pressure level is maintained and from which the lubricating medium is fed by means of the valve arrangement to ductwork leading to respective lubrication targets. By means of the pressure accumulator it is possible to separate the production of pressure and distribution of lubricating oil, whereby the lubrication becomes more effective and better corresponds with actual requirements. Thus the feed of lubricating medium may be controlled, for example so that the starting moment of the feed and/or its duration, is controlled by an external control unit.

In a preferred embodiment the second ducting means is connected to a lubricating channel leading to a piston unit of the engine, whereby the benefits of the invention are especially efficiently utilised. In this case a pressure driven non-return valve or the like is preferably arranged n the piston unit.

In the arrangement according to the invention the valve arrangement is arranged to co-operate with a control unit adapted to control the operation of the valve arrangement. The control unit receives measurement signals sent by sensors measuring parameters of lubrication targets of the engine. The valve arrangement for separate ductwork sections connected to different lubrication targets, and measurement sensors measuring parameters, such as bearing temperatures, of the different lubrication targets are connected to the control unit. Thus, the lubrication of each lubrication target is independently adjustable in dependence on the measurement signals from the sensors. The control unit controls the valve arrangement in dependence on the measurement signals sent by sensors measuring the parameters of the engine and/by stored control information. It is possible to supply measuring value defining parameters of respective lubrication targets to the control unit. Thus the control unit may control each lubrication target independently of other lubrication targets based on the measurement signals and/or stored information. Advantageously the feeding lubricating medium may be controlled so that the starting time and/or duration is controlled by the external control unit.

If the arrangement comprises a separate section with pressure elevating means separate from the pressure elevating means for the lubricating medium delivery ductwork of other parts of the engine, the control unit preferably also controls the operation of the separate pressure elevating means.

According to another aspect of the present invention there is provided a method of lubricating a piston engine comprising feeding lubricating medium from a source of lubricating medium by means of a pump or the like pressure elevating means to a lubricating medium delivery ductwork. From the delivery ductwork the lubricating medium is further fed to at least one lubrication target of the engine. Part of the lubricating medium fed to the at least one lubrication target is preferably fed through a separate pressure elevating means independent from operation of other pressure elevating means for the lubricating medium, to a certain lubrication target by means of a valve arrangement provided in connection with the separate ductwork. The valve arrangement is controlled by an external, independent control.

The invention results in several benefits. The lubrication may be carried out precisely according to requirements of the lubrication target. Additionally lubrication may be controlled based on actual, for example measured, engine values, whereby the lubrication corresponds to the needs set by operating conditions. Moreover, by means of the invention it is possible to take the quality of lubricating medium into account, for example so that lubrication is altered according to service life of the lubricating medium.

BRIEF DESCRIPTION OF DRAWINGS

Embodiments of the invention will be described, by way of example only, with particular reference to the accompanying drawings, in which.

DETAILED DESCRIPTION OF PREFERRED EMBODIMENTS

Figure 1:
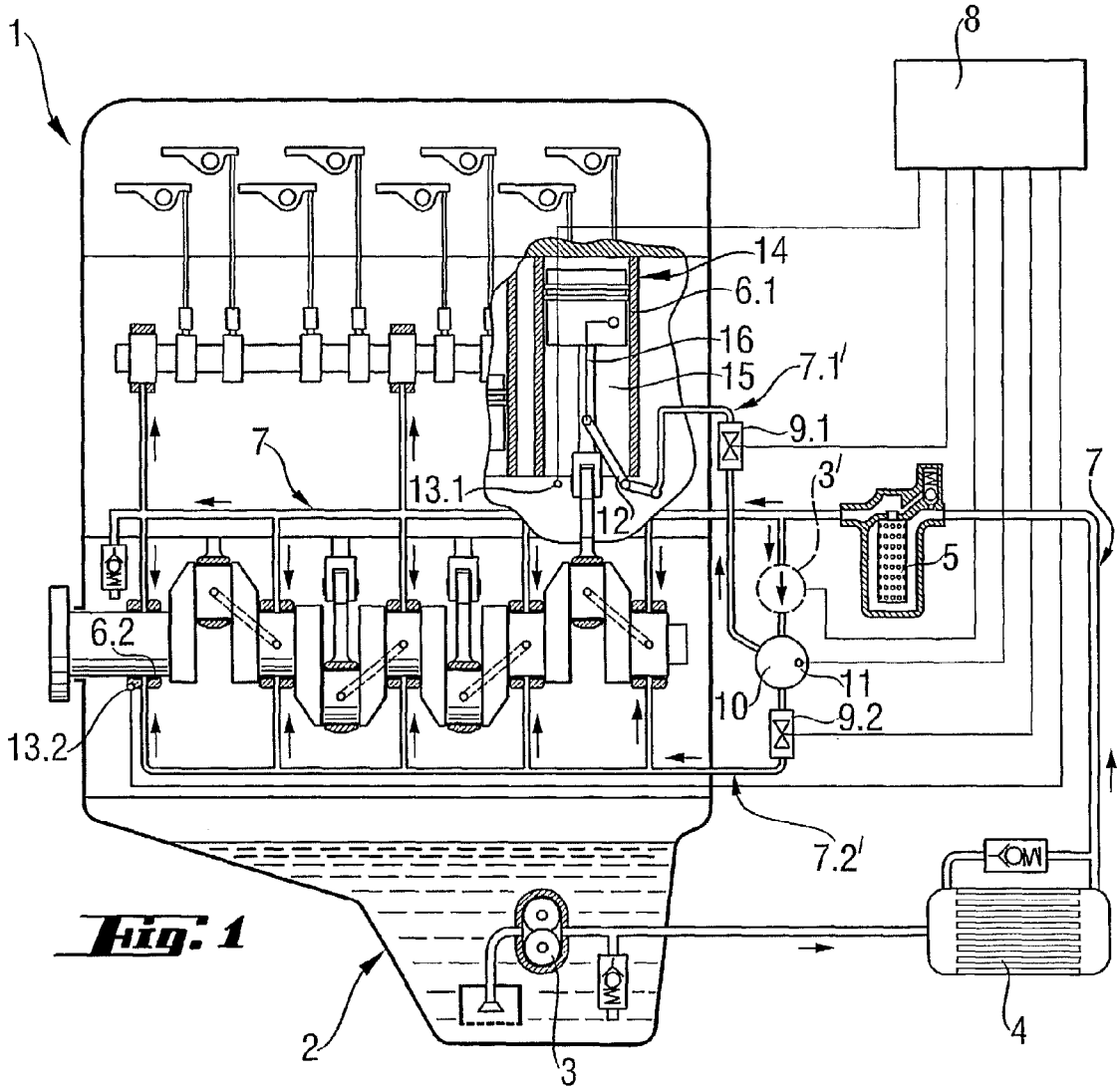
FIG. 1 is a schematic view of one embodiment of an arrangement according to the invention for lubricating a piston engine.

FIG. 1 shows schematically a lubrication arrangement of a piston engine 1. The engine 1 comprises an oil sump 2, as a source of lubricating medium, from which an oil pump 3 sucks oil and pumps it through a cooler 4 and a filter 5 to lubricating medium ductwork 7 leading to locations to be lubricated. From the lubricated locations, such as piston lubrication 6.1 and crankshaft lubrication 6.2, oil drains back to the bottom of crankcase to the oil sump 2. The lubrication arrangement according to the invention comprises at least one ducting means i.e. ductwork section 7.1',7.2' provided with a valve arrangement 9.1,9.2 of its own and a control unit 8. The ductwork section 7.1',7.2' is preferably independently controllable and separate from the other lubricating medium delivery ductwork 7. The valve arrangement 9.1,9.2 is controllable by means of the control unit 8 for controlling the flow of lubricating oil in the ductwork section 7.1',7.2'. In the embodiment of FIG. 1 the ductwork section 7.1',7.2' is connected to a first branching part of the delivery ductwork 7 in a flow direction of the lubricating medium after the pressure elevating means 3. Advantageously the arrangement also comprises a pressure accumulator 10 in flow communication with the source of lubricating medium 2. The ductwork section 7.1',7,2' is connected to the pressure accumulator 10 by means of the valve arrangement 9.1,9.2. With the pressure accumulator it is possible to ensure adequate flow rate of oil while a valve or valves of the valve arrangement 9.1,9.2 are opened. In FIG. 1 there is shown in dotted line an optional additional separate pump 3' which may be used for raising the pressure to a higher level than prevailing in the other delivery ductwork 7. Thus the oil pump of the engine, in addition to other lubrication, pumps oil to the pressure accumulator 10, from which oil is fed by means of valves of the valve arrangement 9.1,9.2 to pre-selected lubrication targets by controlling the starting moment and the duration of the feeding.

The arrangement of the invention may be utilised, for example, in hydrodynamic bearings. The main bearings 6.2, amongst other bearings, are commonly hydrodynamic bearings. By utilising the invention it is possible, for example, to separate the bearing surfaces from each other by opening the valve 9.2 for a period of time during the starting stage of the engine 1, while the operation of the bearing has not yet stabilised with respect of its rotation speed. In this way it is possible to avoid overheating of the bearing, whereby its service life and replacement interval are considerably increased. According to the timing controlled lubrication of the invention it is possible to positively affect on other lubrication targets as well.

Sensors 13.1, 13.2 are provided for monitoring and measuring the parameters of the engine 1. Based on the measurement signals provided by the sensors it is possible to control the lubrication. The valve arrangement 9.1,9.2, independently controllable by external control, is arranged in co-operation with a control unit 8. The control unit 8 is adapted to control the operation of the valve arrangement 9.1,9.2 by receiving measurement signals from the sensors 13.1, 13.2 measuring the parameters of the lubrication targets 6.1,6.2, respectively, of the engine. This may be realised advantageously so that a valve arrangement 9.1,9.2 of a ductwork section connected to a certain lubrication target 6.1,6.2, and a measurement sensor 13.1, 13.2 measuring parameters of the same lubrication target, such as bearing temperature, are connected in cooperation with the control unit 8, whereby the lubrication of the lubrication target is independently adjustable based on measurement information. The control unit 8 may have other information or set values stored therein or fed thereto influencing or affecting the lubrication, its requirements and efficiency.

Figure 2:
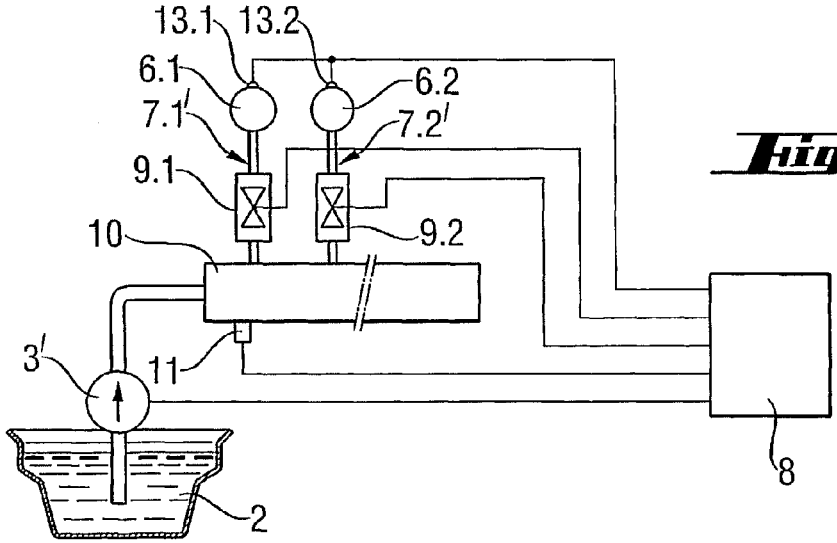
FIG. 2 is a schematic view of another embodiment of a lubrication arrangement according to the invention.

The arrangement of FIG. 2 shows a totally separate ductwork section from any other lubricating system of the engine 1. The separate lubricating section comprises a separate pressure elevating means 3' operationally independent from the lubrication oil elevating means 3 of the engine 1. The separate pressure elevating means 3' sucks lubrication oil from an oil source, such as oil sump 2. In some cases the source of lubrication oil may also be external and separate from the oil source for other lubrication of the engine. As can be seen from FIG. 2 the arrangement preferably comprises a pressure accumulator 10, to which the separate, second oil pump 3' feeds oil and maintains a desired pressure level. The volume of the pressure accumulator 10 is arranged so that the pressure is enough for respective oil flow rate requirement. The pump 3' may be driven separately from or be independently settable from means for rotating the engine, for example it may be driven by an electric motor. The control unit 8 may control the output of the pump directly or indirectly by controlling, for example, the speed of rotation of the electric motor or the amount of oil by-pass flow rate (not shown). In connection with the pressure accumulator 10 there may be a pressure sensor 11 the output of which may be fed to the control unit 8 to adjust the operation of the pump 3'. The pressure prevailing in the accumulator 10 may, according to need and lubrication target, be from a few bars even up to thousands of bars. For different lubrication targets there may be provided also several distinct pressure accumulators. Each valve arrangement 9.1,9.2 preferably comprise a magnetic valve, whereby the starting moment and duration of oil flow/pressure pulse may be adjusted extremely accurately under control of the control unit 8. An adequate number of valves 9.1,9.2 are provided in connection with the pressure accumulator 10. It is possible, according to the invention, by utilising the pressure accumulator and the valves, to separate the production of pressure and distribution of lubricating oil, whereby the lubrication becomes more effective and better corresponds to actual needs.

The duration of the feed of the lubricating medium may at its shortest be even parts of a millisecond. In lubricating rotating bearings (6.2) the pressure pulse may be triggered to be, for example, in synchronism with passing of lubrication openings of a rotating part of the bearing.

Figure 3:
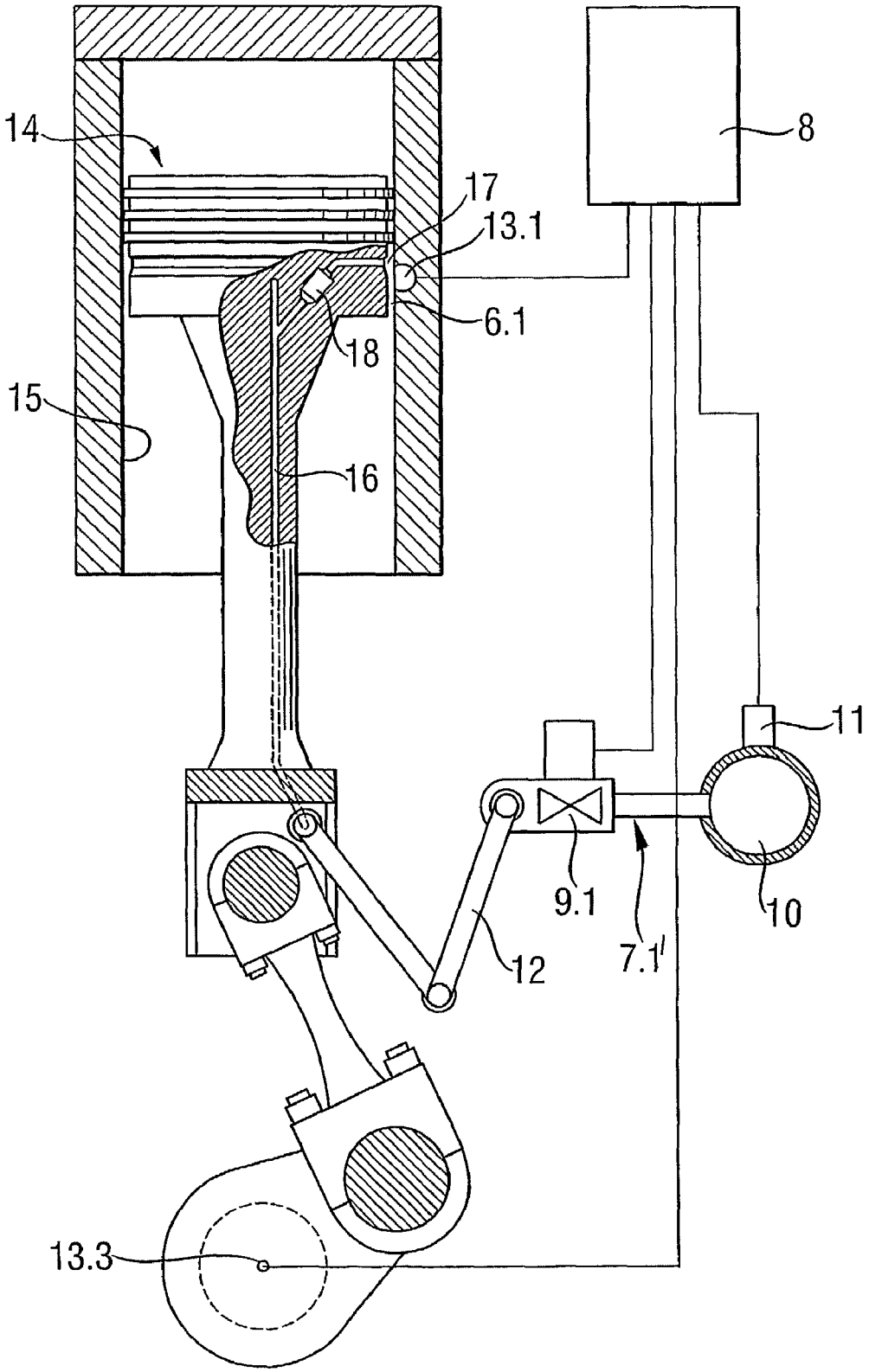
FIG. 3 is a lubrication arrangement according to the invention for lubricating a piston.

A preferred application of the invention is piston lubrication for low speed, large two-stroke engines. This application is schematically illustrated in FIG. 1 and in a more detailed manner in FIG. 3. In this case the lubrication principle may be partly or also totally of the fresh-oil lubrication type. In FIG. 3 there is shown the principle of feeding oil to a piston unit 14 and further to lubricating between the piston and cylinder 15. Lubrication oil is fed through a separate pipe linkage 12 to the piston in a manner known as such. The oil is led first to the pressure accumulator 10, as described above, in which a desired pressure is maintained. Oil is rationed for lubrication by means of the valve arrangement 9.1 under control of the control unit 8. The piston unit is provided with ductwork 16 for leading oil to the lubrication of the piston and the cylinder. The duct opens via an outlet into a groove 17 arranged in the piston, by means of which groove the oil may spread to whole perimeter of the piston. The ductwork 16 is provided in this kind of application with a pressure driven valve 18 or the like, so that withdrawal of oil from the system is prevented during a break of oil feed. The valve 18 or the like is preferably provided in the piston unit 14 and more specifically in the piston in vicinity of the outlet. This kind of valve may, for example, be a non-return valve. By maintaining the ductwork filled with oil it is ensured that delay in oil feed is minimal. In this embodiment the timing of lubrication oil feed is determined by the control unit 8 based on information sent by one or several sensors measuring the parameters of the engine. The sensor(s) may be adapted to measure, for example, temperature or position of each piston of the engine, 13.1, or position information of rotational angle of the crankshaft 13.3. The feeding of oil is preferably carried out while the piston is moving towards top dead centre.

The invention has been described above in connection with a large two-stroke engine, but it is clear that the invention may be adapted to other types of piston engines. Additionally the invention is applicable to lubrication of several targets, such as sliding show in cross head engines. Thus it is clear that the solutions described above are only exemplary. The invention is not limited to the embodiments shown but several modifications of the invention are reasonable within the scope of the attached claims.

What is claimed is:

1. A piston engine comprising:

a source of lubricating medium, a first ducting means leading to lubrication targets of the engine, a first pressure elevating means for drawing lubricating medium from the source of lubricating medium and delivering lubricating medium under pressure to said lubrication targets by way of the first ducting means, a second ducting means for serving a lubrication target of the engine, the second ducting means including a pressure accumulator and also including a valve means for controlling flow of lubricating medium from the pressure accumulator to the lubrication target served by the second ducting means, and an external control unit for controlling operation of the valve means, and wherein the lubrication target that is served by the second ducting means comprises a piston unit of the piston engine and the second ducting means is connected to the piston unit via a lubricating channel.

2. A piston engine according to claim 1, wherein the second ducting means further comprises a second pressure elevating means separate from the first pressure elevating means.

3. A piston engine according to claim 1, comprising a second pressure elevating means having a suction side connected to the first ducting means and a pressure side connected to the second ducting means.

4. A piston engine according to claim 1, wherein the second ducting means is connected to the first ducting means.

5. A piston engine according to claim 4, wherein the second ducting means is connected to the first ducting means as a branch duct at a location downstream of the first pressure elevating means with respect to flow of lubricating medium in the first ducting means.

6. A piston engine according to claim 1, comprising a pressure-driven nonreturn valve disposed in the piston unit for controlling emission of lubricating medium from the lubricating channel.

7. A piston engine according to claim 1, comprising a sensor for sensing an operating parameter at a lubrication target and supplying a sensor signal that depends on the operating parameter to the control unit.

8. A piston engine according to claim 1, comprising a sensor for sensing an operating parameter at the lubrication target that is served by the second ducting means and supplying a sensor signal that depends on the operating parameter to the control unit.

9. A piston engine comprising:

a source of lubricating medium, a first ducting means leading to lubrication targets of the engine, a first pressure elevating means for drawing lubricating medium from the source of lubricating medium and delivering lubricating medium under pressure to said lubrication targets by way of the first ducting means, a second ducting means servicing at least first and second lubrication targets, wherein the second ducting means includes a pressure accumulator, a first valve means for controlling flow of lubricating medium from the pressure accumulator to said first lubrication target, and a second valve means for controlling flow of lubricating medium from the pressure accumulator to said second lubrication target, whereby lubrication of said first lubrication target can be controlled independently of lubrication of said second lubrication target, and an external control unit for controlling operation of the first and second valve means.

10. A piston engine comprising:

a source of lubricating medium, a first ducting means leading to lubrication targets of the engine, a first pressure elevating means for drawing lubricating medium from the source of lubricating medium and delivering lubricating medium under pressure to said lubrication targets by way of the first ducting means, a pressure accumulator, a second ducting means for serving a lubrication target of the engine, a valve means for controlling flow of lubricating medium from the pressure accumulator to the lubrication target that is served by the second ducting means, and an external control means for controlling operation of the valve means, and wherein the lubrication target that is served by the second ducting means comprises a piston unit of the piston engine and the second ducting means is connected to the piston unit via a lubricating channel.

11. A piston engine according to claim 10, comprising a second pressure elevating means having a suction side connected to the first ducting means and a pressure side connected to the second ducting means.

12. A piston engine according to claim 10, comprising a pressure-driven nonreturn valve disposed in the piston unit for controlling emission of lubricating medium from the lubricating channel.

13. A piston engine according to claim 10, comprising a sensor for sensing an operating parameter at the lubrication target that is served by the second ducting means and supplying a sensor signal that depends on the operating parameter to the control unit.

14. A piston engine comprising:

a source of lubricating medium, a first ducting means leading to lubrication targets of the engine, a first pressure elevating means for drawing lubricating medium from the source of lubricating medium and delivering lubricating medium under pressure to said lubrication targets by way of the first ducting means, a pressure accumulator, a second ducting means serving at least first and second lubrication targets of the engine, wherein the second ducting means includes a first valve means for controlling flow of lubricating medium from the pressure accumulator to said first lubrication target and a second valve means for controlling flow of lubricating medium from the pressure accumulator to said second lubrication target, whereby lubrication of said first lubrication target can be controlled independently of lubrication of said second lubrication target, and an external control means for controlling operation of the valve means.

15. A method of lubricating a piston engine comprising:

drawing lubricating medium from a source of lubricating medium and delivering the lubricating medium under pressure to a lubrication target by way of a first lubricating medium delivery duct, feeding lubricating medium to a pressure accumulator, maintaining a predetermined pressure in the pressure accumulator, feeding lubricating medium from the pressure accumulator to first and second lubrication targets by way of a second lubricating medium delivery duct, employing a first valve to control feeding of lubricating medium from the pressure accumulator to the first lubrication target by way of the second lubricating medium delivery duct, wherein the first valve is responsive to an external control, and employing a second valve to control feeding of lubricating medium to the first lubrication target.

16. A method according to claim 15, comprising employing a sensor to generate a measurement signal that depends on an operating parameter of the engine and controlling the first valve in response to the measurement signal.

17. A method according to claim 15, comprising employing a plurality of sensors to generate measurement signals that depend on operating parameters at respective lubrication targets and controlling at least one valve in response to the measurement signals.

18. A method according to claim 15, comprising controlling the start time and duration of feeding of lubricating medium to the first lubrication target by way of the second lubricating medium delivery duct.

* * * * *